US010770000B2

(12) United States Patent
Yang et al.

(10) Patent No.: US 10,770,000 B2
(45) Date of Patent: Sep. 8, 2020

(54) PIXEL CIRCUIT, DRIVING METHOD, DISPLAY PANEL AND DISPLAY DEVICE

(71) Applicant: BOE TECHNOLOGY GROUP CO., LTD., Beijing (CN)

(72) Inventors: Shengji Yang, Beijing (CN); Xue Dong, Beijing (CN); Jing Lv, Beijing (CN); Xiaochuan Chen, Beijing (CN); Minghua Xuan, Beijing (CN); Lei Wang, Beijing (CN); Dongni Liu, Beijing (CN); Li Xiao, Beijing (CN); Jie Fu, Beijing (CN); Pengcheng Lu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 21 days.

(21) Appl. No.: 16/096,138

(22) PCT Filed: Apr. 24, 2018

(86) PCT No.: PCT/CN2018/084194
§ 371 (c)(1),
(2) Date: Oct. 24, 2018

(87) PCT Pub. No.: WO2018/219066
PCT Pub. Date: Dec. 6, 2018

(65) Prior Publication Data

US 2019/0355305 A1 Nov. 21, 2019

(30) Foreign Application Priority Data

May 31, 2017 (CN) ..... 2017 1 0398726

(51) Int. Cl.
*G09G 3/3258* (2016.01)

(52) U.S. Cl.
CPC ... *G09G 3/3258* (2013.01); *G09G 2300/0426* (2013.01); *G09G 2300/0439* (2013.01)

(58) Field of Classification Search
CPC .. G09G 3/3208; G09G 3/30; G09G 2320/045; G09G 3/3674; G09G 3/3677
(Continued)

(56) References Cited

U.S. PATENT DOCUMENTS

2006/0114193 A1 6/2006 Kwak et al.
2012/0306374 A1 12/2012 Lee et al.
(Continued)

FOREIGN PATENT DOCUMENTS

CN 103474024 A 12/2013
CN 103714777 A 4/2014
(Continued)

OTHER PUBLICATIONS

International Search Report and Written Opinion dated Jul. 9 7, 2018.
Chinese Office Action dated Sep. 20, 2018.

*Primary Examiner* — Yuzhen Shen
(74) *Attorney, Agent, or Firm* — Dilworth & Barrese, LLP.; Michael J. Musella, Esq.

(57) ABSTRACT

A pixel circuit, a driving method, a display panel and a display device. The pixel circuit includes: at least two pixel sub-circuits, a data line, a first scan line, a second scan line, a third scan line and a light-emitting control line. The pixel sub-circuit includes: a light-emitting control sub-circuit, a node reset sub-circuit, a drive control sub-circuit, a write sub-circuit and a light emitting device. The light-emitting control sub-circuit is configured to provide a signal provided by the first voltage signal end to a first node; the node reset sub-circuit is configured to form a conductive path between the first node and a second node; the write sub-circuit is configured to write a data signal provided by the data signal
(Continued)

end and a threshold voltage to the second node; and the drive control sub-circuit is configured to drive the light emitting device to emit light.

18 Claims, 8 Drawing Sheets

(58) Field of Classification Search
USPC ..... 345/76
See application file for complete search history.

(56) References Cited

U.S. PATENT DOCUMENTS

| | | | | |
|---|---|---|---|---|
| 2014/0092076 | A1 | 4/2014 | Lee | |
| 2015/0364085 | A1 | 12/2015 | Kanda et al. | |
| 2016/0086546 | A1 | 3/2016 | Noh et al. | |
| 2016/0155383 | A1 | 6/2016 | Chen | |
| 2016/0155385 | A1 | 6/2016 | Yang | |
| 2016/0204165 | A1* | 7/2016 | Yang | G09G 3/3225 345/174 |
| 2016/0253963 | A1* | 9/2016 | Yang | G09G 3/3225 345/211 |
| 2017/0154576 | A1 | 6/2017 | Sun | |
| 2017/0221419 | A1* | 8/2017 | Xiang | G09G 3/3233 |

FOREIGN PATENT DOCUMENTS

| | | | | |
|---|---|---|---|---|
| CN | 104078004 | A | 10/2014 | |
| CN | 104112427 | A * | 10/2014 | G09G 3/32 |
| CN | 104134426 | A | 11/2014 | |
| CN | 104252845 | A | 12/2014 | |
| CN | 203982748 | U | 12/2014 | |
| CN | 104318898 | A | 1/2015 | |
| CN | 105448234 | A | 3/2016 | |
| CN | 105448241 | A | 3/2016 | |
| CN | 105825813 | A | 8/2016 | |
| CN | 106128362 | A | 11/2016 | |
| CN | 106971691 | A | 7/2017 | |

* cited by examiner

PIXEL CIRCUIT, DRIVING METHOD, DISPLAY PANEL AND DISPLAY DEVICE

CROSS-REFERENCE TO RELATED APPLICATION

The present application claims priority of Chinese Patent Application No. 201710398726.9, filed on May 31, 2017, the disclosure of which is incorporated herein by reference in its entirety as part of the present application.

TECHNICAL FIELD

The embodiments of the present disclosure relate to a pixel circuit and a driving method, a display panel and a display device.

BACKGROUND

Organic light emitting diode (OLED) is one of the research focuses in the field of display. Compared with liquid crystal displays (LCDs), OLEDs have the advantages of low energy consumption, low production cost, self-illuminating, wide viewing angle and fast response speed, etc. Currently, in the fields such as mobile phones, Personal Digital Assistants (PDAs) and digital cameras, OLED display screens have begun to replace traditional LCD display screens. Pixel circuit design is the core technology of the OLED display, and has important research significance.

Unlike LCDs utilizing stable voltages to control the brightness, OLEDs are driven by currents and require stable currents to control light emitting. Due to manufacturing processes, the aging of devices and so on, the threshold voltages $V_{th}$ of drive transistors of the pixel circuit are different, thereby resulting in the differences in currents flowing through different OLED pixels, which causes different display brightness and thus affects the display effect of the whole image.

For example, it is possible to decrease the difference in brightness by arranging more transistors, which, however, would decrease the aperture ratio and is disadvantageous for high-resolution display.

SUMMARY

At least one embodiment of the present disclosure provides pixel circuit, which includes:

at least two pixel sub-circuits; and a data line, a first scan line, a second scan line, a third scan line and a light-emitting control line corresponding to the pixel circuit, wherein each of the pixel sub-circuits includes: a light-emitting control sub-circuit, a node reset sub-circuit, a drive control sub-circuit, a write sub-circuit and a light emitting device, and in each of the pixel sub-circuits:

the light-emitting control sub-circuit is connected with a first voltage signal end, a light-emitting control end and a first node respectively; the light-emitting control sub-circuit is configured to provide a signal provided by the first voltage signal end to the first node under a control of the light-emitting control end;

the node reset sub-circuit is connected with a first scanning signal end, the first node and a second node respectively; the node reset sub-circuit is configured to form a conductive path between the first node and the second node under a control of the first scanning signal end;

the write sub-circuit is connected with a second scanning signal end, a data signal end and the second node respectively; the write sub-circuit is configured to write a data signal provided by the data signal end and a threshold voltage to the second node under a control of the second scanning signal end;

the drive control sub-circuit is connected with the first end, the second node and the light emitting device respectively; the drive control sub-circuit is configured to drive the light emitting device to emit light under a control of the second node; and the light emitting device is connected between the drive control sub-circuit and the second voltage signal end.

For example, each of the pixel sub-circuits further includes a regulating sub-circuit, and in each of the pixel sub-circuits, the regulating sub-circuit is connected between the second node and the second voltage signal end, and is configured to maintain a potential of the second node.

For example, the data signal end of each of the pixel sub-circuits is connected with the data line, the first scanning signal end of each of the pixel sub-circuits is connected with the first scanning signal line, the light-emitting control end of each of the pixel sub-circuits is connected with the light-emitting control line, the second scanning signal end of a first pixel sub-circuit of the at least two pixel sub-circuits is connected with the second scanning signal line, and the second scanning signal end of a second pixel sub-circuit of the at least two pixel sub-circuits is connected with the third scanning signal line.

For example, the light-emitting control sub-circuit of each of the pixel sub-circuits includes a first switching transistor, and a gate of the first switching transistor is connected with the light-emitting control end, a source of the first switching transistor is connected with the first voltage signal end, and a drain of the first switching transistor is connected with the first node.

For example, the node reset sub-circuit of each of the pixel sub-circuits includes a second switching transistor, and a gate of the second switching transistor is connected with the first scanning signal end, a source of the second switching transistor is connected with the first node, and a drain of the second switching transistor is connected with the second node.

For example, the write sub-circuit of each of the pixel sub-circuits includes: a third switching transistor and a fourth switching transistor, and a gate of the third switching transistor is connected with the second scanning signal end, a source of the third switching transistor is connected with the data signal end, and a drain of the third switching transistor is connected with a source of the fourth switching transistor, and a gate of the fourth switching transistor is connected with the second node, a source of the fourth switching transistor is connected with the drain of the switching transistor, and a drain of the fourth switching transistor is connected with the second node.

For example, the drive control sub-circuit of each of the pixel sub-circuits includes a drive transistor, and a gate of the drive transistor is connected with the first scanning signal end, a source of the drive transistor is connected with the first node, and a drain of the drive transistor is connected with the light emitting device.

For example, the regulating sub-circuit of each of the pixel sub-circuits includes a first capacitor, and the first capacitor is connected between the second node and the second voltage signal end.

For example, all of the switching transistors are N-type transistors.

At least one embodiment of the present disclosure provides a method of driving any one of the above-mentioned pixel circuits, which includes:

at a reset period, for each of the pixel sub-circuits: providing a signal provided by the first voltage signal end to the first node by the light-emitting control sub-circuit under a control of the light-emitting control end; and forming a conductive path between the first node and the second node by the node reset sub-circuit under a control of the first scanning signal end;

at a first writing period, writing, by the write sub-circuit of the pixel sub-circuit connected with the second scan line under a control of the signal provided by the second scan line, the threshold voltage and the first data signal provided by the data signal end to the second node of the pixel sub-circuit connected with the second scan line;

at a second writing period, writing, by the write sub-circuit of the pixel sub-circuit connected with the third scan line under a control of the signal provided by the third scan line, the threshold voltage and the second data signal provided by the data signal end to the second node of the pixel sub-circuit connected with the third scan line; and at a light emitting period, for each of the pixel sub-circuits: providing a signal provided by the first voltage signal end to the first node by the light-emitting control sub-circuit under a control of the light-emitting control end; maintaining a voltage at the second node by the regulating sub-circuit; and driving the light emitting device to emit light by the drive control sub-circuit under a control of the second node.

At least one embodiment of the present disclosure provides a display panel, which includes a plurality of the above-mentioned pixel circuits, and the plurality of the pixel circuits is arranged in a matrix, each column of the pixel circuits shares a single data line, and each row of the pixel circuits shares a single first scan line, a single second scan line, a single third scam line and a single light-emitting control line.

At least one embodiment of the present disclosure provides a display device which includes any one of the above-mentioned display panel.

BRIEF DESCRIPTION OF THE DRAWINGS

In order to clearly illustrate the technical solution of the embodiments of the invention, the drawings of the embodiments will be briefly described in the following. Evidently, the described drawings are only related to some embodiments of the present disclosure and thus are not limitative of the present disclosure. Based on these drawings, those skilled in the art can obtain other drawing(s), without any inventive work.

DETAILED DESCRIPTION

The technical solutions of the embodiments of the present disclosure will be described in a clearly and fully understandable way in connection with the drawings related to the embodiments of the present disclosure. Apparently, the described embodiments are just a part but not all of the embodiments of the invention. Based on the described embodiments herein, those skilled in the art can obtain other embodiment(s), without any inventive work, which should be within the scope of the invention.

Figure 1:
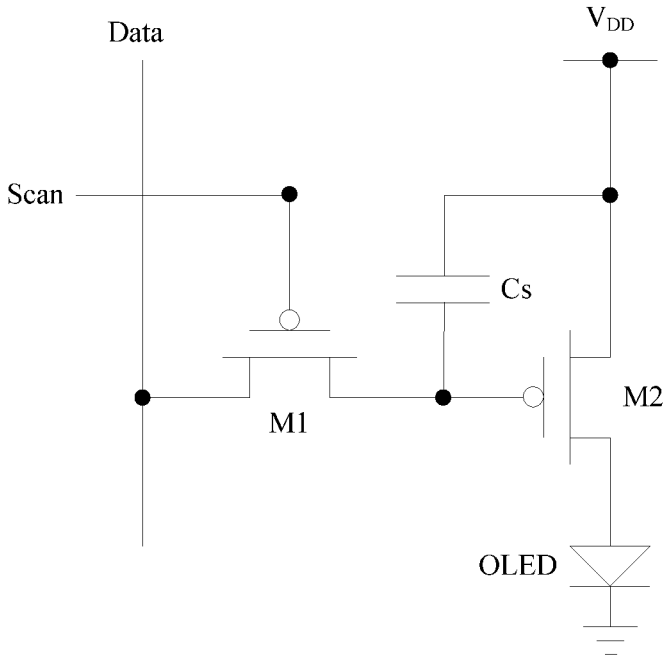
FIG. 1 is a structural schematic diagram of a 2T1C pixel circuit.

A 2T1C pixel circuit, as shown in FIG. 1, consists of a drive transistor M2, a switching transistor M1 and a storage capacitance Cs. When a scan line Scan selects a row, the scan line Scan inputs a low level signal, the P-type switching transistor M1 is turned on, and the voltage on the data line Data is written into the storage capacitance Cs; when scanning of the row is completed, the signal inputted by the scan line Scan is shifted to a high level, the P-type switching transistor M1 is turned off, the drive transistor M2 is controlled by the voltage stored by the storage capacitance Cs to generate currents to drive the OLED pixel, thereby ensuring the OLED pixel to continuously emit light in one frame. For example, the saturation current formula of the drive transistor M2 is $I_{OLED}=K(V_{SG}-V_{th})^2$, where $V_{SG}$ is the voltage difference between the source and the drain of the drive transistor M2, K is a structural coefficient, $V_{th}$ is the threshold voltage of the drive transistor M2. As stated above, due to manufacturing processes, the aging of devices and so on, the threshold voltages $V_{th}$ of the drive transistors T2 may shift, thereby resulting in the change of currents flowing through different OLED pixels caused by the differences in the threshold voltages $V_{th}$ of the drive transistors, which causes different display brightness.

Embodiments of a pixel circuit, a driving method, a display panel and a display device provided by the present disclosure will be described below in detail with reference to accompanying drawings.

The pixel circuit, the driving method, the display panel and the display device provided by some embodiments of the present disclosure can increase an aperture ratio and improve display quality while ensuring uniform image brightness. For example, the pixel circuit includes: two pixel sub-circuits, a data line, a first scan line, a second scan line, a third scan line and a light-emitting control line corresponding to the pixel circuit; wherein each of the pixel sub-circuits includes: a light-emitting control sub-circuit, a node reset sub-circuit, a drive control sub-circuit, a write sub-circuit, a regulating sub-circuit and a light emitting device; two pixel sub-circuits share the same data line so that one pixel circuit may drive two pixels, thereby greatly reducing the distance between pixels, increasing the aperture ratio, realizing high-resolution display and improving display quality. For each pixel sub-circuit, the pixel circuit may cause the driving current of the drive control sub-circuit for driving the light emitting device to emit light to be irrelevant to the threshold voltage of the drive control sub-circuit and a first voltage signal through the cooperation of the individual sub-circuits, thereby avoiding the impact of the threshold voltage of the drive control sub-circuit on the light emitting device, i.e., obtaining images of the same brightness in case of providing the same data signal to different pixel units. Thus, the image brightness uniformity in the display area of the display device is improved.

Figure 2:
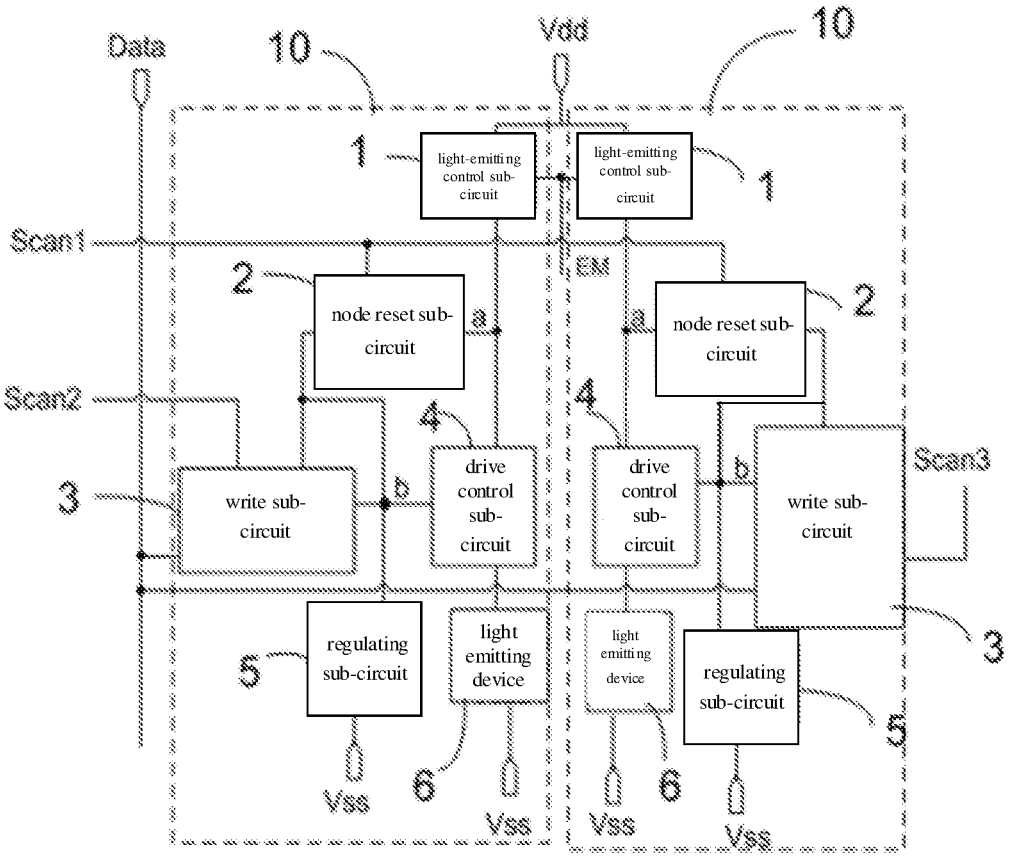
FIG. 2 is a structural schematic diagram of a pixel circuit provided by some embodiments of the present disclosure.

As shown in FIG. 2, a pixel circuit provided by some embodiments of the present disclosure includes: at least two pixel sub-circuits 10; and a data line Data, a scan line Scan1, a second scan line Scan2, a third scan line Scan3 and a light-emitting control line EM corresponding to the pixel circuit. Each of the pixel sub-circuits 10 includes: a light-emitting control sub-circuit 1, a node reset sub-circuit 2, a drive control sub-circuit 4, a write sub-circuit 3, a regulating sub-circuit 5 and a light emitting device 6.

For each pixel sub-circuit 10, the light-emitting control sub-circuit 1 is connected with a first voltage signal end Vdd, a light-emitting control end and a first node a respectively; the light-emitting control sub-circuit is configured to provide a signal provided by the first voltage signal end Vdd to the first node a under the control of the light-emitting control end.

The node reset sub-circuit 2 is connected with a first scanning signal end, the first node a and a second node b respectively. The node reset sub-circuit is configured to form a conductive path between the first node a and the second node b under the control of the first scanning signal end.

The write sub-circuit 3 is connected with a second scanning signal end, a data signal end and the second node b respectively. The write sub-circuit 3 is configured to write a data signal provided by the data signal end and a threshold voltage to the second node b under the control of the second scanning signal end.

The drive control sub-circuit 4 is connected with the first node a, the second node b and the light emitting device 6 respectively. The drive control sub-circuit 4 is configured to drive the light emitting device 6 to emit light under the control of the second node b.

The light emitting device 6 is connected between the drive control sub-circuit 4 and a second voltage signal end Vss.

The regulating sub-circuit 5 is connected between the second node and the second voltage signal end Vss, and is configured to maintain the potential of the second node b.

The data signal ends of the two pixel sub-circuits 10 are both connected with the data line Data, the first scanning signal ends of the two pixel sub-circuits 10 are both connected with the first scanning signal line Scan1, and the light-emitting control ends of the two pixel sub-circuits 10 are both connected with the light-emitting control line EM. The second scanning signal end of one of the pixel sub-circuits 10 (for example, the sub-pixel 10 on the left side of FIG. 2) is connected with a second scanning signal line Scan2, and the second scanning signal end of another one of the pixel sub-circuits 10 (for example, the sub-pixel 10 on the right side of FIG. 2) is connected with a third scanning signal line Scan3.

In the pixel sub-circuits 10 of the embodiments of the present disclosure, the end connected with the data line Data is referred to as the data signal end, the end connected with the scanning signal line Scan is referred to as the scanning signal end, and the end connected with the light-emitting control line EM is referred to as the light-emitting control end. Each pixel sub-circuit 10 includes a first scanning signal end connected with the first scan line Scan1, and a second scanning signal end connected with the second scan line Scan2 or the third scan line Scan3.

The above-mentioned pixel circuit provided by some embodiments of the present disclosure includes: at least two pixel sub-circuits, a data line, a first scan line, a second scan line, a third scan line and a light-emitting control line corresponding to the pixel circuit; wherein each of the pixel sub-circuits includes: a light-emitting control sub-circuit, a node reset sub-circuit, a drive control sub-circuit, a write sub-circuit, a regulating sub-circuit and a light emitting device. Two pixel sub-circuits share the same data line so that one pixel circuit may drive two pixels, thereby greatly reducing the distance between pixels, increasing the aperture ratio, realizing high-resolution display and improving display quality. For each pixel sub-circuit, the pixel circuit may cause the driving current of the drive control sub-circuit for driving the light emitting device to emit light to be irrelevant to the threshold voltage of the drive control sub-circuit and a first voltage signal through the cooperation of the individual sub-circuits, thereby avoiding the impact of the threshold voltage of the drive control sub-circuit on the light emitting device, i.e., obtaining images of the same brightness in case of providing the same data signal to different pixel units. Thus, the image brightness uniformity in the display area of the display device is improved.

The present disclosure will be described in detail in conjunction with specific embodiments. It should be noted that these embodiments are provided to illustrate the present disclosure, but not to limit the present disclosure.

Figure 3:
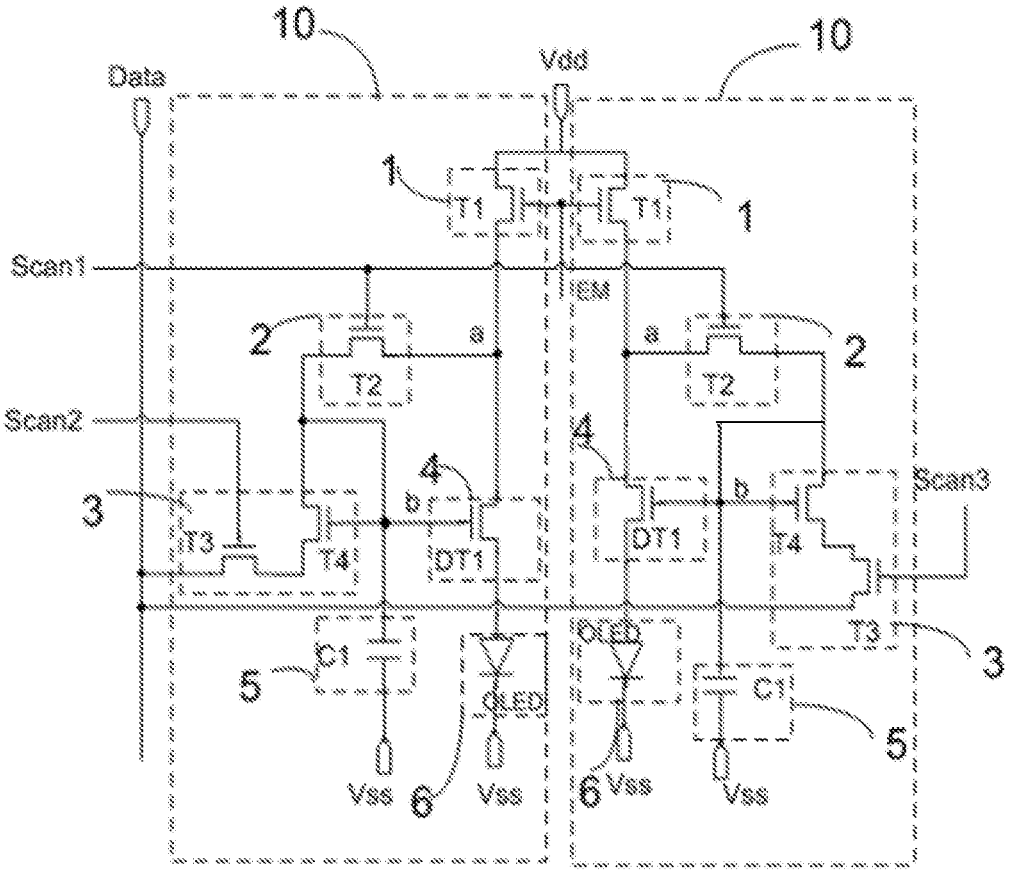
FIG. 3 is a structural schematic diagram of a specific pixel circuit provided by some embodiments of the present disclosure.

For example, in the above-mentioned pixel circuit provided by some embodiments of the present disclosure as shown in FIG. 3, the light-emitting control sub-circuit 1 of each pixel sub-circuit 10 includes: a first switching transistor T1.

The gate of the first switching transistor T1 is connected with the light-emitting control end, the source of the first switching transistor T1 is connected with the first voltage signal end Vdd, and the drain of the first switching transistor T1 is connected with the first node a.

Further, in specific implementations, as shown in FIG. 3, the first switching transistor T1 may be an N-type transistor, and in this case, when the light-emitting control signal VEM provided by the light-emitting control end has a high level, the first switching transistor T1 is in a turned-on state, and when the light-emitting control signal VEM provided by the light-emitting control end has a low level, the first switching transistor T1 is in a turned-off state; the first switching transistor T1 may also be a P-type transistor (not shown), and in this case, when the light-emitting control signal VEM provided by the light-emitting control end has a low level, the first switching transistor T1 is in a turned-on state, and when the light-emitting control signal VEM provided by the light-emitting control end has a high level, the first switching transistor T1 is in a turned-off state; the present disclosure has no limitation in this aspect.

Specifically, in the above-mentioned pixel circuit provided by some embodiments of the present disclosure, when the first switching transistor is in the turned-on state under the control of the light-emitting control signal, the first voltage signal provided by the first voltage signal end is transmitted to the first node through the turned-on first switching transistor.

The specific structure of the light-emitting control sub-circuit of the pixel circuit is illustrated by way of examples above, and in specific implementations, the specific structure of the light-emitting control sub-circuit is not limited to the above-mentioned structures provided by the embodiments of the present disclosure, and may adopt other structures known to those skilled in the art, and the present disclosure has no limitation in this aspect.

For example, in the above-mentioned pixel circuit provided by some embodiments of the present disclosure as shown in FIG. 3, the node reset sub-circuit 2 of each pixel sub-circuit 10 includes: a second switching transistor t2.

The gate of the second switching transistor T2 is connected with the first scanning signal end, the source of the second switching transistor T2 is connected with the first node a, and the drain of the second switching transistor T2 is connected with the second node b.

Further, in specific implementations, as shown in FIG. 3, the second switching transistor T2 may be an N-type transistor, and in this case, when the first scanning signal VScan1 provided by the first scanning signal end has a high level, the second switching transistor T2 is in a turned-on state, and when the first scanning signal VScan1 provided by the first scanning signal end has a low level, the second switching transistor T2 is in a turned-off state; the second switching transistor T2 may also be a P-type transistor (not shown), and in this case, when the first scanning signal VScan1 provided by the first scanning signal end has a low level, the second switching transistor T2 is in a turned-on state, and when the first scanning signal VScan1 provided by the first scanning signal end has a high level, the second switching transistor T2 is in a turned-off state; the present disclosure has no limitation in this aspect.

Specifically, in the above-mentioned pixel circuit provided by the embodiments of the present disclosure, when the second switching transistor is in the turned-on state under the control of the first scanning signal, the first voltage signal provided by the first node is transmitted to the second node through the turned-on second switching transistor.

The specific structure of the node reset sub-circuit of the pixel circuit is illustrated by way of examples above, and in specific implementations, the specific structure of the node reset sub-circuit is not limited to the above-mentioned structures provided by the embodiments of the present disclosure, and may adopt other structures known to those skilled in the art, and the present disclosure has no limitation in this aspect.

For example, in the above-mentioned pixel circuit provided by the embodiments of the present disclosure as shown in FIG. 3, the write sub-circuit 3 of each pixel sub-circuit 10 includes: a third switching transistor T3 and a fourth switching transistor T4.

The gate of the third switching transistor T3 is connected with the second scanning signal end, the source of the third switching transistor T3 is connected with the data signal end, and the drain of the third switching transistor T3 is connected with the source of the fourth switching transistor T4.

The gate of the fourth switching transistor T4 is connected with the second node b, the source of the fourth switching transistor T4 is connected with the drain of the third switching transistor T3, and the drain of the fourth switching transistor T4 is connected with the second node b.

Further, in specific implementations, as shown in FIG. 3, the third switching transistor T3 may be an N-type transistor, and in this case, when the signal provided by the second scanning signal end has a high level, the third switching transistor T3 is in a turned-on state, and when the signal provided by the second scanning signal end has a low level, the third switching transistor T3 is in a turned-off state; the third switching transistor T3 may also be a P-type transistor (not shown), and in this case, when the signal provided by the second scanning signal end has a low level, the third switching transistor T3 is in a turned-on state, and when the signal provided by the second scanning signal end has a high level, the third switching transistor T3 is in a turned-off state; the present disclosure has no limitation in this aspect.

Further, in specific implementations, as shown in FIG. 3, the fourth switching transistor T4 may be an N-type transistor, and in this case, when the voltage at the second node b has a high level, the fourth switching transistor T4 is in a turned-on state, and when the voltage at the second node b has a low level, the fourth switching transistor T4 is in a turned-off state.

Specifically, in the above-mentioned pixel circuit provided by the embodiments of the present disclosure, when the third switching transistor is in the turned-on state under the control of the first scanning signal, the data signal is transmitted to the source of the fourth switching transistor through the turned-on third switching transistor. When the fourth switching transistor is in a turned-on state under the control of the voltage at the second node, the data signal and the threshold voltage of the fourth switching transistor are written to the second node.

It should be noted that as shown in FIG. 3, the second scanning signal end of the pixel sub-circuit 10 on the left side is connected with the second scanning signal line Scan2 so that the gate of the third switching transistor T3 on the left side is connected with the second scanning signal line Scan2; the second scanning signal end of the pixel sub-circuit 10 on the right side is connected with the third scanning signal line Scan3 so that the gate of the third switching transistor T3 on the right side is connected with the third scanning signal line Scan3.

The specific structure of the write sub-circuit of the pixel circuit is illustrated by way of examples above, and in specific implementations, the specific structure of the write sub-circuit is not limited to the above-mentioned structures provided by the embodiments of the present disclosure, and may adopt other structures known to those skilled in the art, and the present disclosure has no limitation in this aspect.

For example, in the above-mentioned pixel circuit provided by the embodiments of the present disclosure as shown in FIG. 3, the drive control sub-circuit 4 of each pixel sub-circuit 10 includes: a drive transistor DT1.

The gate of the drive transistor DT1 is connected with the second node b, the source of the drive transistor DT1 is connected with the first node a, and the drain of the drive transistor DT1 is connected with the light emitting device 6.

In specific implementations, in the above-mentioned pixel circuit provided by the embodiments of the present disclosure, the drive transistor DT1 is an N-type transistor. In order to ensure that the drive transistor DT1 can operate normally, the voltage of the corresponding first voltage signal is usually positive, and the voltage of the second voltage signal is usually grounded or negative. Certainly, the drive transistor DT1 may also be a P-type transistor, the present disclosure has no limitation in this aspect.

For example, in the above-mentioned pixel circuit provided by the embodiments of the present disclosure as shown in FIG. 3, the regulating sub-circuit 5 includes: a first capacitor C1, which is connected between the second node b and the second voltage signal end Vss. In specific implementations, the capacitor C1 is used to regulate the voltage at the second node b.

For example, in the above-mentioned pixel circuit provided by the embodiments of the present disclosure, all of the switching transistors may be N-type transistors, and the present disclosure has no limitation in this aspect.

For example, all of the drive transistors and the switching transistors in the above-mentioned pixel circuit provided by the embodiments of the present disclosure may be N-type transistors, and in this way, the lag effect of the pixels may be reduced and the manufacture process of the pixel circuit may also be simplified.

It should be noted that the above-mentioned embodiments are illustrated by taking N-type transistors as the drive transistors, and embodiments where the drive transistors are P-type transistors and adopt the same design principle also fall within the protection scope of the present disclosure.

In specific implementations, the drive transistor and the switching transistor may be thin film transistors (TFTs), or metal oxide semiconductor field-effect transistors (MOS), and the present disclosure has no limitation in this aspect. In specific implementations, the source and the drain of these transistors may be interchangeable based on the type of the transistors and the input signals, and the present disclosure has no limitation in this aspect.

The working process of the pixel circuit provided by the embodiments of the present disclosure will be described by taking the pixel circuit shown in FIG. 3 as an example below. In the following description, "1" is used to designate a high level signal, and "0" is used to designate a low level signal.

Figure 4:
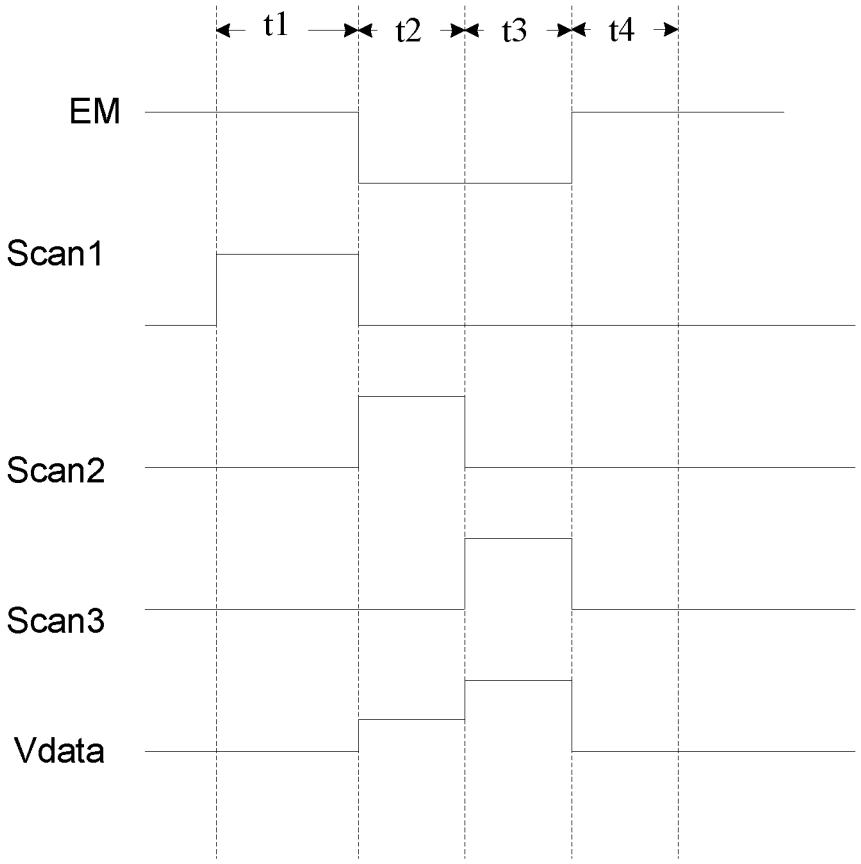
FIG. 4 is a timing diagram of the pixel circuit of FIG. 3.

In the pixel circuit as shown in FIG. 3, the drive transistor DT1 and all the switching transistors are N-type transistors, and the N-type transistor is turned off in case of a low level and is turned on in case of a high level; the corresponding input timing diagram is shown in FIG. 4. Specifically, in the periods t1, t2, t3 and t4 of the input timing diagram as shown in FIG. 4, VScan1 represents the first scanning signal provided by the first scanning signal line, VScan2 represents the second scanning signal provided by the second scanning signal line, and VScan3 represents the third scanning signal provided by the third scanning signal line.

At t1, VEM=1, VScan1=1, VScan2=0, VScan3=0, Vdata=0.

For each pixel sub-circuit 10 in the pixel circuit, the first switching transistor T1 and the second switching transistor T2 are in the turned-on state, the drive transistor DT1, the third switching transistor T3 and the fourth switching transistor T4 are in the turned-off state. The first voltage signal provided by the first voltage signal end Vdd is transmitted to the first node a through the turned-on first switching transistor T1, and thus the voltage at the first node a is the voltage of the first voltage signal; the voltage at the first node a is provided to the second node b through the turned-on second switching transistor T2 to reset the voltage at the second node b, and in this period, the voltage at the second node b is the voltage of the first voltage signal.

At t2, VEM=0, VScan1=0, VScan2=1, VScan3=0, Vdata=Vdata1.

In the pixel sub-circuit 10 connected with the second scanning signal line Scan2, the third switching transistor T3 is in the turned-on state under the control of the second scanning signal VScan2, and at the same time, the fourth switching transistor T4 is also in the turned-on state under the control of the voltage at the second node b, and the first switching transistor T1 and the second switching transistor T2 are in the turned-off state. The first data signal Vdata1 provided by the data signal end Data is provided to the source of the fourth switching transistor T4 through the turned-on third switching transistor T3, and since the fourth switching transistor T4 has a diode connection structure, the first data signal Vdata1 is transmitted to the second node b through the diode connection structure of the fourth switching transistor T4 and the voltage at the second node b is changed from the voltage of the first voltage signal to Vdata1+Vth1 at this period, i.e., the first data signal Vdata1 and the threshold voltage Vth1 is written to the second node b, wherein the Vth1 is the threshold voltage of the fourth switching transistor T4. At this period, even if the drive transistor DT1 is turned on by the voltage at the second node b, the OLED does not emit light since the transistor T1 is turned off.

At t2, in the pixel sub-circuit 10 connected with the third scanning signal line Scan3, the switching transistor T1, T2, T3 are not turned on. Since the switching transistor T3 is not turned on, the data Vdata1 will not be written to the second node b (i.e., the second node b of the pixel sub-circuit 10 on the right side in FIG. 3) of the pixel sub-circuit 10 connected with the third scanning signal line Scan3.

At t3, VEM=0, VScan1=0, VScan2=0, VScan3=1, Vdata=Vdata2.

In the pixel sub-circuit 10 connected with the third scanning signal line Scan3, the third switching transistor T3 is in the turned-on state under the control of the third scanning signal VScan3, and at the same time, the fourth switching transistor T4 is also in the turned-on state under the control of the voltage at the second node b, and the first switching transistor T1 and the second switching transistor T2 are in the turned-off state. The second data signal Vdata2 provided by the data signal end Data is provided to the source of the fourth switching transistor T4 through the turned-on third switching transistor T3, and since the fourth switching transistor T4 has a diode connection structure, the second data signal Vdata2 is transmitted to the second node b through the diode connection structure of the fourth switching transistor T4 and the voltage at the second node b is changed from the voltage of the first voltage signal to Vdata2+Vth1 at this period, i.e., the second data signal Vdata2 and the threshold voltage Vth1 is written to the second node b, wherein the Vth1 is the threshold voltage of the fourth switching transistor T4. At this period, even if the drive transistor DT1 is turned on by the voltage at the second node b, the OLED does not emit light since the transistor T1 is turned off.

At t3, in the pixel sub-circuit 10 connected with the second scanning signal line Scan2, the switching transistors T1, T2, T3 are not turned on. Since the switching transistor T3 is not turned on, the data Vdata2 is not written to the second node b (i.e., the second node b of the pixel sub-circuit 10 on the left side in FIG. 3) of the pixel sub-circuit 10 connected with the second scanning signal line Scan2, and at this point, the voltage at the second node b of the pixel sub-circuit 10 connected with the second scanning signal line Scan2 is still Vdata1+Vth1.

At t4, VEM=1, VScan1=0, VScan2=0, VScan3=0, Vdata=0.

For each pixel sub-circuit 10 in the pixel circuit, the first switching transistor T1 and the drive transistor DT1 are in the turned-on state, the second switching transistor T2 and the third switching transistor T3 are in the turned-off state. Under the control of the light-emitting control end, the first voltage signal provided by the first voltage signal end Vdd is transmitted to the first node a through the turned-on first switching transistor T1 to drive the light emitting device 6 to emit light through the drive transistor DT1, wherein the light emitting device 6 is the organic light emitting diode (OLED). At this point, the voltage difference between the gate and the drain of the drive transistor DT1 is Vdata+Vth1-Voled, and the current flowing through the drive transistor DT1 is:

$$I_{OLED} = K(VGS - Vth2)^2$$
$$= K[Vdata + Vth1 - Voled - Vth2]^2$$

where $I_{OLED}$ is the current flowing through the drive transistor DT1, K is an operation coefficient, VGS is the voltage difference between the gate and the drain of the drive transistor DT1, Vth2 is the threshold voltage of the drive transistor DT1, Vdata is the data signal at t2 or t3, Vth1 is the threshold voltage of the fourth switching transistor T4, and Voled is the voltage applied on the light emitting device.

Since Vth1 and Vth2 are the threshold voltage of the fourth switching transistor T4 and that of the drive transistor DT1 respectively, the fourth switching transistor T4 is near to the drive transistor DT1, and the fourth switching transistor T4 and the drive transistor DT1 may be manufactured by the same process in manufacturing, Vth1 and Vth2 are considered to be approximately equal, i.e., Vth1=Vth2, and thus $I_{OLED}$=K(Vdata−Voled)$^2$.

Therefore, for the pixel sub-circuit on the left side of FIG. 3, since Vdata=Vdata1 at t2, the current flowing through the drive transistor DT1 is: $I_{OLED}$=K(Vdata1−Voled)$^2$, where Vdata1 is the data signal provided by the data signal end Data at t2. Similarly, the current flowing through the drive transistor DT1 of the pixel sub-circuit on the right side of FIG. 3 is: $I_{OLED}$=K(Vdata2−Voled)$^2$, where Vdata2 is the data signal provided by the data signal end Data at t3.

Therefore, the driving current of the drive control sub-circuit for driving the light emitting device to emit light is only related to the voltage of the data signal and the voltage of the light emitting device, and is irrelevant to the threshold voltage of the drive control sub-circuit, thereby avoiding the impact of the threshold voltage of the drive control sub-circuit on the light emitting device, i.e., obtaining images of the same brightness in case of providing the same data signal to different pixel units. Thus, the image brightness uniformity in the display area of the display device is improved. Moreover, in the pixel circuit provided by the embodiments of the present disclosure, each pixel sub-circuit may be implemented by five transistors and one capacitor, and thus the structure is simple, which is in favor of realizing the high-resolution display panel.

It should be noted that when the voltage changes during t2 and t3, the voltage is unstable, the light emitting device does not emit light, and all the light emitting devices emit light at t4 to extend the life time of the OLED.

Figure 5:
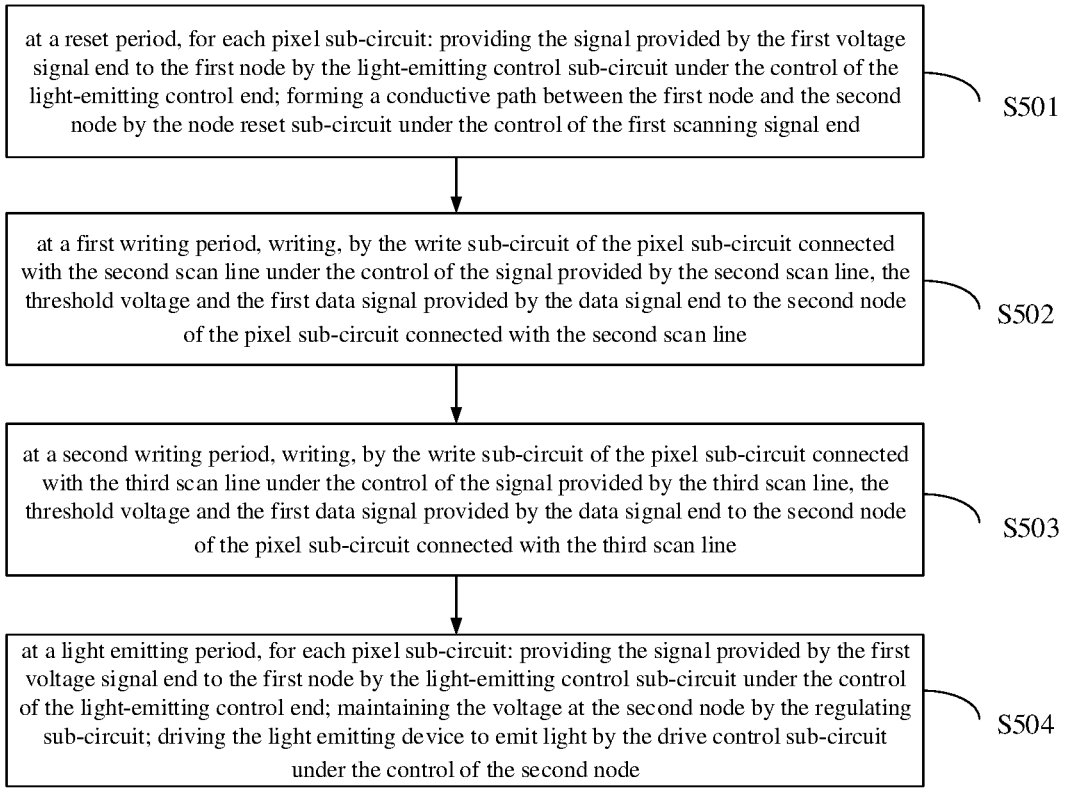
FIG. 5 is a schematic flow chart of a method of driving a pixel circuit provided by some embodiments of the present disclosure.

Based on the same inventive concept, some embodiments of the present disclosure further provide a method of driving the pixel circuit as mentioned above, which, as shown in FIG. 5, includes the following steps.

S501, at a reset period, for each pixel sub-circuit: providing the signal provided by the first voltage signal end to the first node by the light-emitting control sub-circuit under the control of the light-emitting control end; forming a conductive path between the first node and the second node by the node reset sub-circuit under the control of the first scanning signal end.

S502, at a first writing period, writing, by the write sub-circuit of the pixel sub-circuit connected with the second scan line under the control of the signal provided by the second scan line, the threshold voltage and the first data signal provided by the data signal end to the second node of the pixel sub-circuit connected with the second scan line.

S503, at a second writing period, writing, by the write sub-circuit of the pixel sub-circuit connected with the third scan line under the control of the signal provided by the third scan line, the threshold voltage and the first data signal provided by the data signal end to the second node of the pixel sub-circuit connected with the third scan line.

S504, at a light emitting period, for each pixel sub-circuit: providing the signal provided by the first voltage signal end to the first node by the light-emitting control sub-circuit under the control of the light-emitting control end; maintaining the voltage at the second node by the regulating sub-circuit; driving the light emitting device to emit light by the drive control sub-circuit under the control of the second node.

The timing of the method of driving the pixel circuit is shown in FIG. 4, and specifically, t1 is the reset period, t2 is the first writing period, t3 is the second writing period and t4 is the light emitting period. The specific operation principle may refer to the explanation of FIG. 4 when describing the structure of the pixel circuit, which will not be repeated herein.

Figure 8:
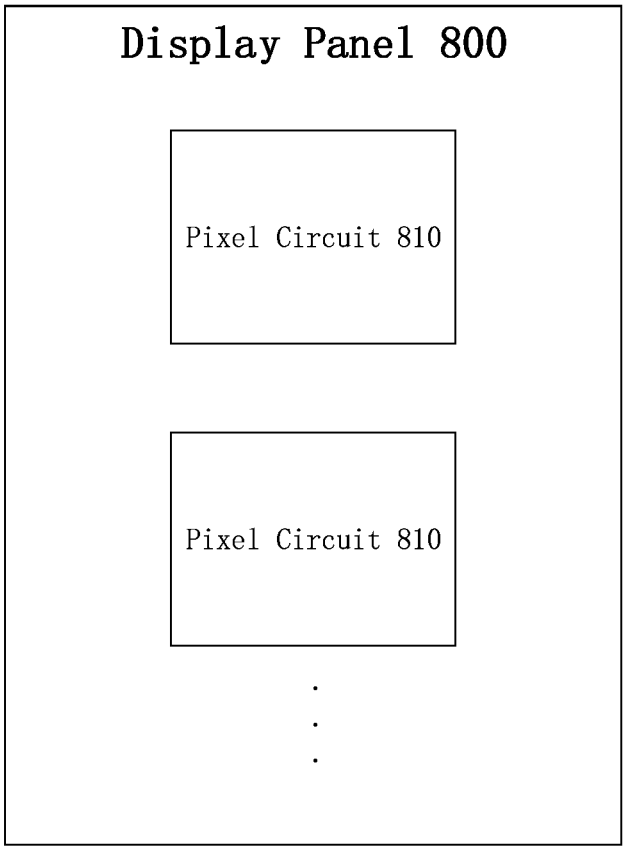
FIG. 8 is a schematic diagram of a display panel provided by some embodiments of the present disclosure.

Based on the same inventive concept, some embodiments of the present disclosure further provide a display panel, which includes a plurality of the pixel circuits provided by the embodiments of the present disclosure, and the pixel circuits are arranged in a matrix. As shown in FIG. 8, a display panel 800 includes a plurality of pixel circuits 810, and the pixel circuit 810 may be any one of the above-mentioned pixel circuit. Since the principle of solving problems of the display panel is similar to that of the above-mentioned pixel circuit, the implementations of the pixel circuit of the display panel may refer to those of the pixel circuit of the above-mentioned embodiments, which will not be repeated herein.

In specific implementations, each column of pixel circuits shares a single data line, and each row of pixel circuits shares a single first scan line, a single second scan line, a single third scam line and a single light-emitting control line.

Figure 6:
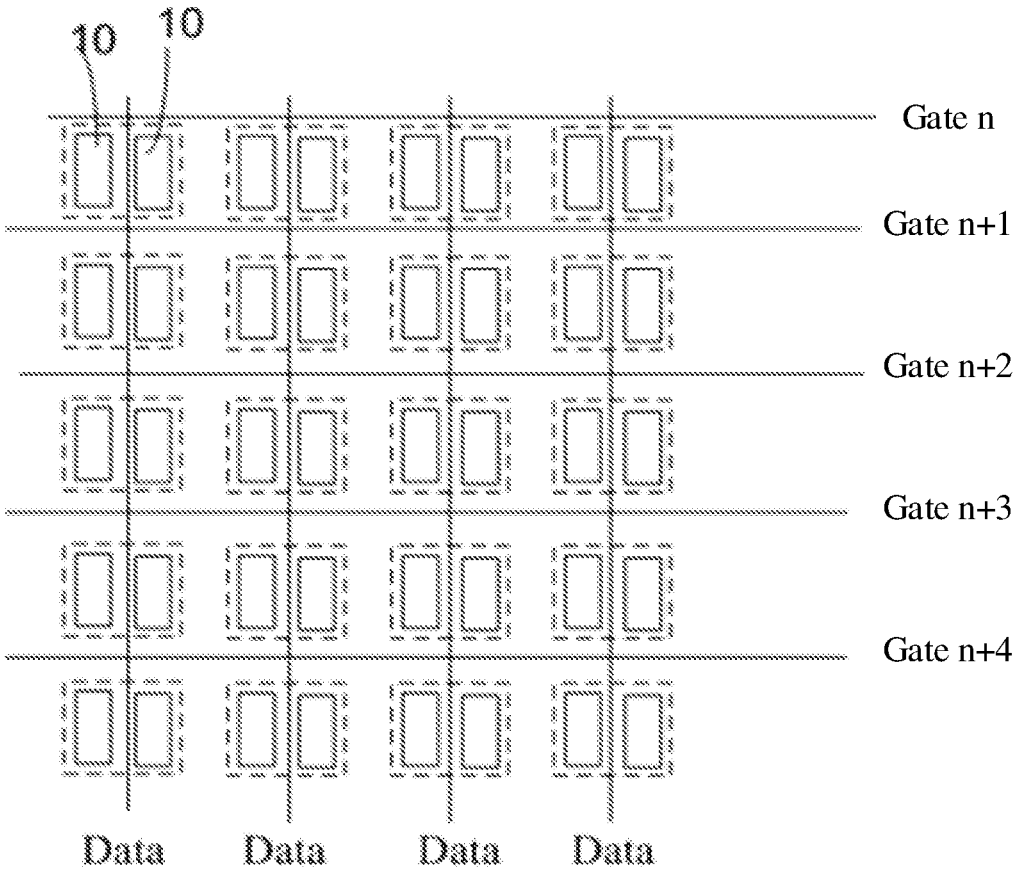
FIG. 6 is a schematic diagram of an arrangement of pixel circuits provided by some embodiments of the present disclosure.
Figure 7:
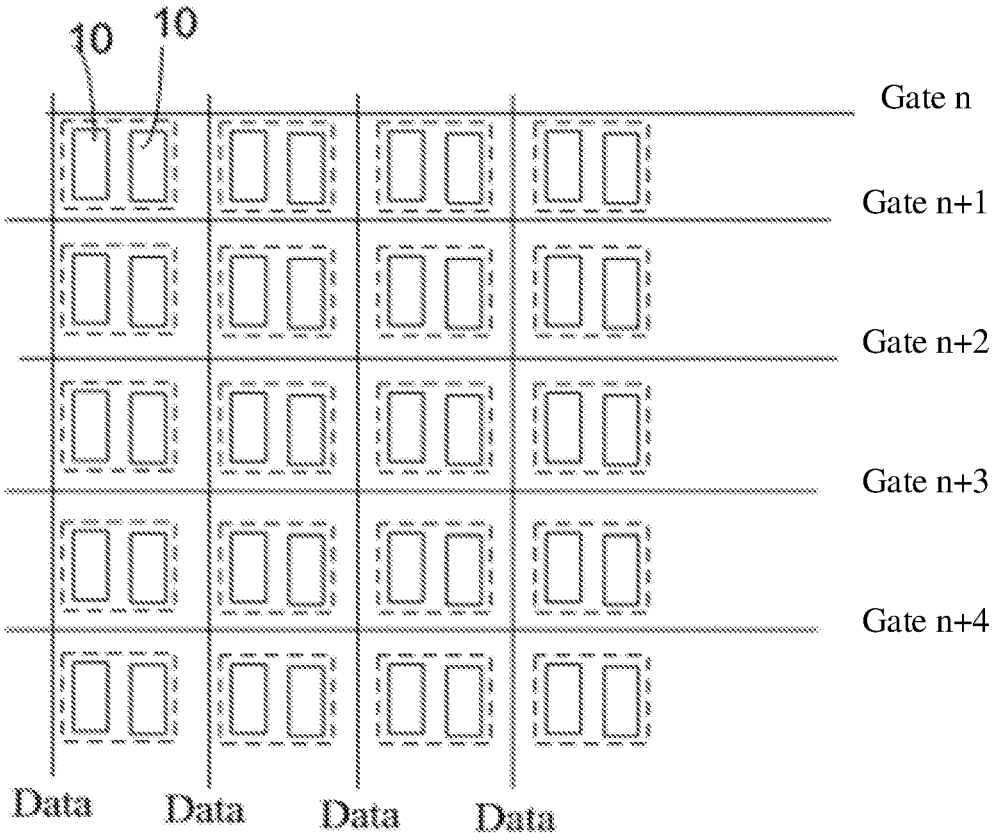
FIG. 7 is a schematic diagram of another arrangement of pixel circuits provided by some embodiments of the present disclosure.

In specific implementations, in the display panel provided by the embodiments of the present disclosure, as shown in FIG. 6, the data line Data may be arranged between two pixel sub-circuits 10 of the same pixel circuit, and as shown in FIG. 7, the data line Data may also be arranged on the same side of two pixel sub-circuits 10 of the same pixel circuit, and the present disclosure has no limitation in this aspect.

Since the first scan line, the second scan line and the third scan line in each pixel circuit are sequentially scanned based on the time sequence, the first scan line, the second scan line and the third scan line in the pixel circuits in different rows may be shared. Taking the pixel circuits in the n-th row and the (n+1)-th as an example, as shown in FIGS. 6 and 7, Gate n is the first scan line of the pixel circuit in the n-th row, Gate n+1 is the second scan line of the pixel circuit in the n-th row, Gate n+2 is the third scan line of the pixel circuit in the n-th row, Gate n+1 is the first scan line of the pixel circuit in the (n+1)-th row, Gate n+2 is the second scan line of the pixel circuit in the (n+1)-th row, Gate n+3 is the third scan line of the pixel circuit in the (n+1)-th row, and so on, which will not described in detail.

Figure 9:
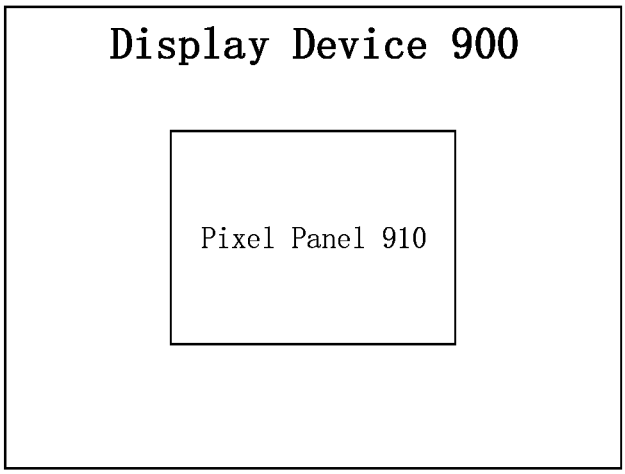
FIG. 9 is a schematic diagram of a display device provided by some embodiments of the present disclosure.

Based on the same inventive concept, some embodiments of the present disclosure provide a display device, which includes the display panel provided by some embodiments of the present disclosure. As shown in FIG. 9, a display device 900 includes a display panel 910, and the pixel circuit 910 may be any one of the above-mentioned display panel. The display device may be a display, a mobile phone, a television, a notebook computer, an electronic paper, a digital photo frame, a navigator, an all-in-one computer, and the like. Those skilled in the art could know that the display device may also include other necessary components, which will not be described herein and should not limit the present disclosure.

It will be apparent to those skilled in the art that various modifications and variations may be made to the embodiments of the present disclosure without departing from the spirit and scope of the present disclosure. Thus, it is intended that the present disclosure encompasses such modifications and variations, if such modifications and variations are within the scope of the claims of the present disclosure and equivalents thereof.

The foregoing are merely exemplary embodiments of the disclosure, but the protection scope of the present disclosure is not limited thereto, and those skilled in the art can easily think of modifications or substitutions within the technical scope of the present disclosure, which should fall within the protection scope of the present disclosure. Therefore, the protection scope of the present disclosure should be defined by the appended claims.

What is claimed is:

1. A display panel, comprising a plurality of pixel circuits, wherein each of the plurality of pixel circuits comprises at least two pixel sub-circuits; and a data line, a first scan line, a second scan line, a third scan line and a light-emitting control line corresponding to the pixel circuit, each of the pixel sub-circuits comprises: a light-emitting control sub-circuit, a node reset sub-circuit, a drive control sub-circuit, a write sub-circuit and a light emitting device, and in each of the pixel sub-circuits:

the light-emitting control sub-circuit is connected with a first voltage signal end, a light-emitting control end and a first node respectively: the light-emitting control sub-circuit is configured to provide a signal provided by the first voltage signal end to the first node under a control of the light-emitting control end;

the node reset sub-circuit is connected with a first scanning signal end, the first node and a second node respectively: the node reset sub-circuit is configured to form a conductive path between the first node and the second node under a control of the first scanning signal end;

the write sub-circuit is connected with a second scanning signal end, a data signal end and the second node respectively: the write sub-circuit is configured to write a data signal provided by the data signal end and a threshold voltage to the second node under a control of the second scanning signal end;

the drive control sub-circuit is connected with the first node, the second node and the light emitting device respectively; the drive control sub-circuit is configured to drive the light emitting device to emit light under a control of the second node; and the light emitting device is connected between the drive control sub-circuit and the second voltage signal end, the plurality of the pixel circuits is arranged in a matrix;

each column of the pixel circuits shares a single data line, and each row of the pixel circuits shares a single first scan line, a single second scan line, a single third scam line and a single light-emitting control line, the plurality of pixel circuits comprises N rows of pixel circuits, N is an integer greater than 3, and the first scan line of an (n+1)th row of the pixel circuits is reused as the second scan line of an nth row of the pixel circuits, the first scan line of an (n+2)th row of the pixel circuits is reused as the third scan line of an nth row of the pixel circuits, n is an integer greater than or equal to 1, and n is less than or equal to N−2.

2. A display device comprising the display panel according to claim 1.

3. The display panel according to claim 1, wherein each of the pixel sub-circuits further comprises a regulating sub-circuit, and in each of the pixel sub-circuits, the regulating sub-circuit is connected between the second node and the second voltage signal end, and is configured to maintain a potential of the second node.

4. The display panel according to claim 3, wherein the regulating sub-circuit of each of the pixel sub-circuits comprises a first capacitor, and the first capacitor is connected between the second node and the second voltage signal end.

5. The display panel according to claim 3, wherein the data signal end of each of the pixel sub-circuits is connected with the data line, the first scanning signal end of each of the pixel sub-circuits is connected with the first scanning signal line, the light-emitting control end of each of the pixel sub-circuits is connected with the light-emitting control line, the second scanning signal end of a first pixel sub-circuit of the at least two pixel sub-circuits is connected with the second scanning signal line, and the second scanning signal end of a second pixel sub-circuit of the at least two pixel sub-circuits is connected with the third scanning signal line.

6. The display panel according to claim 3, wherein the light-emitting control sub-circuit of each of the pixel sub-circuits comprises a first switching transistor, and a gate of the first switching transistor is connected with the light-emitting control end, a source of the first switching transistor is connected with the first voltage signal end, and a drain of the first switching transistor is connected with the first node.

7. The display panel according to claim 3, wherein the node reset sub-circuit of each of the pixel sub-circuits comprises a second switching transistor, and a gate of the second switching transistor is connected with the first scanning signal end, a source of the second switching transistor is connected with the first node, and a drain of the second switching transistor is connected with the second node.

8. The display panel according to claim 3, wherein the write sub-circuit of each of the pixel sub-circuits comprises: a third switching transistor and a fourth switching transistor, and a gate of the third switching transistor is connected with the second scanning signal end, a source of the third switching transistor is connected with the data signal end, and a drain of the third switching transistor is connected with a source of the fourth switching transistor, and a gate of the fourth switching transistor is connected with the second node, a source of the fourth switching transistor is connected with the drain of the third switching transistor, and a drain of the fourth switching transistor is connected with the second node.

9. The display panel according to claim 1, wherein the data signal end of each of the pixel sub-circuits is connected with the data line, the first scanning signal end of each of the pixel sub-circuits is connected with the first scanning signal line, the light-emitting control end of each of the pixel sub-circuits is connected with the light-emitting control line, the second scanning signal end of a first pixel sub-circuit of the at least two pixel sub-circuits is connected with the second scanning signal line, and the second scanning signal end of a second pixel sub-circuit of the at least two pixel sub-circuits is connected with the third scanning signal line.

10. The display panel according to claim 9, wherein the light-emitting control sub-circuit of each of the pixel sub-circuits comprises a first switching transistor, and a gate of the first switching transistor is connected with the light-emitting control end, a source of the first switching transistor is connected with the first voltage signal end, and a drain of the first switching transistor is connected with the first node.

11. The display panel according to claim 9, wherein the node reset sub-circuit of each of the pixel sub-circuits comprises a second switching transistor, and a gate of the second switching transistor is connected with the first scanning signal end, a source of the second switching transistor is connected with the first node, and a drain of the second switching transistor is connected with the second node.

12. The display panel according to claim 9, wherein the write sub-circuit of each of the pixel sub-circuits comprises: a third switching transistor and a fourth switching transistor, and a gate of the third switching transistor is connected with the second scanning signal end, a source of the third switching transistor is connected with the data signal end, and a drain of the third switching transistor is connected with a source of the fourth switching transistor, and a gate of the fourth switching transistor is connected with the second node, a source of the fourth switching transistor is connected with the drain of the third switching transistor, and a drain of the fourth switching transistor is connected with the second node.

13. The display panel according to claim 1, wherein the light-emitting control sub-circuit of each of the pixel sub-circuits comprises a first switching transistor, and a gate of the first switching transistor is connected with the light-emitting control end, a source of the first switching transistor is connected with the first voltage signal end, and a drain of the first switching transistor is connected with the first node.

14. The display panel according to claim 13, wherein all of the switching transistors are N-type transistors.

15. The display panel according to claim 13, wherein the node reset sub-circuit of each of the pixel sub-circuits comprises a second switching transistor, and a gate of the second switching transistor is connected with the first scanning signal end, a source of the second switching transistor is connected with the first node, and a drain of the second switching transistor is connected with the second node.

16. The display panel according to claim 1, wherein the node reset sub-circuit of each of the pixel sub-circuits comprises a second switching transistor, and a gate of the second switching transistor is connected with the first scanning signal end, a source of the second switching transistor is connected with the first node, and a drain of the second switching transistor is connected with the second node.

17. The display panel according to claim 1, wherein the write sub-circuit of each of the pixel sub-circuits comprises: a third switching transistor and a fourth switching transistor, and a gate of the third switching transistor is connected with the second scanning signal end, a source of the third switching transistor is connected with the data signal end, and a drain of the third switching transistor is connected with a source of the fourth switching transistor, and a gate of the fourth switching transistor is connected with the second node, a source of the fourth switching transistor is connected with the drain of the third switching transistor, and a drain of the fourth switching transistor is connected with the second node.

18. The display panel according to claim 1, wherein the drive control sub-circuit of each of the pixel sub-circuits comprises a drive transistor, and a gate of the drive transistor is connected with the second node, a source of the drive transistor is connected with the first node, and a drain of the drive transistor is connected with the light emitting device.

* * * * *